US008734183B2

(12) United States Patent
Omae et al.

(10) Patent No.: US 8,734,183 B2
(45) Date of Patent: May 27, 2014

(54) CONNECTING STRUCTURE OF SHIELD TERMINALS

(75) Inventors: Takashi Omae, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 14 days.

(21) Appl. No.: 13/634,346

(22) PCT Filed: Apr. 8, 2011

(86) PCT No.: PCT/JP2011/058880
§ 371 (c)(1),
(2), (4) Date: Sep. 12, 2012

(87) PCT Pub. No.: WO2011/129270
PCT Pub. Date: Oct. 20, 2011

(65) Prior Publication Data

US 2013/0029524 A1 Jan. 31, 2013

(30) Foreign Application Priority Data

Apr. 13, 2010 (JP) ..... 2010-092176

(51) Int. Cl.
*H01R 13/648* (2006.01)

(52) U.S. Cl.
USPC ..... 439/607.01

(58) Field of Classification Search
USPC ..... 439/607.01–607.51
See application file for complete search history.

(56) References Cited

U.S. PATENT DOCUMENTS 5,456,618 A * 10/1995 Nakamura ..... 439/607.48
5,603,639 A * 2/1997 Lai et al. ..... 439/607.31
6,485,844 B1 * 11/2002 Strangman et al. ..... 428/632
6,991,493 B2 * 1/2006 Matsui et al. ..... 439/579
8,366,486 B1 * 2/2013 Lan et al. ..... 439/607.54
2005/0118858 A1 6/2005 Matsui et al.
2009/0093157 A1 * 4/2009 Aoki et al. ..... 439/607
2013/0029524 A1 * 1/2013 Omae et al. ..... 439/607.01
2013/0237074 A1 * 9/2013 Yagome et al. ..... 439/135

FOREIGN PATENT DOCUMENTS

JP 2005-129391 A 5/2005
JP 2008-235190 A 10/2008

OTHER PUBLICATIONS

International Search Report dated May 17, 2011, issued for PCT/JP2011/058880.

* cited by examiner

*Primary Examiner* — Chandrika Prasad
(74) *Attorney, Agent, or Firm* — Edwards Wildman Palmer LLP

(57) ABSTRACT

A connecting structure of shield terminals configured to tighten and connect a pair of shield terminals with a single bolt simultaneously in a smaller space, the structure includes: two shield terminals each having a circular portion into which a braided wire of a shield electric wire is inserted and connected, a plate portion extended from the ring-shaped portion along the shield electric wire, and a projecting piece extended perpendicular to the plate portion from a tip of the plate portion and having a bolt-insertion hole at the center thereof, wherein one wall of the projecting piece is positioned on an extension of a center line (m) of the ring-shaped portion, wherein one shield terminal is inverted 180 degree, and wherein the one wall of the projecting piece of the one shield terminal is overlapped with and abuts on the one wall of the projecting piece of the other shield terminal.

3 Claims, 5 Drawing Sheets

CONNECTING STRUCTURE OF SHIELD TERMINALS

TECHNICAL FIELD

This invention relates to a connecting structure of shield terminals to connect shield terminals having the same shape inverted to each other with a conductive housing with a screw while the shield terminals are connected with braided wires of a plurality of shield electric wires.

BACKGROUND ART

As an embodiment of a conventional connecting structure of shield terminals, for example, in PLT1, it is described to connect left-and-right pair of shield terminals with braided wires of shield electric wires. Each shield terminal is composed of a ring-shaped portion to be inserted over the braided wire, an L-shaped plate portion extended vertically from the ring-shaped portion, and a bolt-insertion hole provided on the plate portion. While plate portions of both shield terminals are overlapped with each other up and down, a single bolt is inserted into both bolt-insertion holes. Then, the shield terminals are fixed to and connected to a box-shaped metallic shield shell with a nut.

CITATION LIST

Patent Literature

[PLT1]
JP, A, 2005-129391 (FIG. 2)

SUMMARY OF INVENTION

Technical Problem

However, in the conventional connecting structure of shield terminals described in PLT1, because the plate portion of one shield terminal is overlapped with the plate portion of the other shield terminal, the shape and the size of the shield terminal is different from each other, and there is a problem that components cannot be shared (the number of components cannot be reduced). Therefore, when two of any one of shield terminals are used, and ring-shaped portions are connected to the braided wires of the shield electric wires respectively, there is a problem that the plate portions are projected in the same direction and occupy a large space, and a single bolt cannot tighten two shield terminals simultaneously.

Accordingly, an object of the present invention is to provide a connecting structure of shield terminals for allowing a single bolt to tighten a pair of shield terminals simultaneously in a small space, and to reduce the number of components and component cost by sharing one type of shield terminal.

Solution to Problem

For attaining the object, according to the invention claimed in claim 1, there is provided a connecting structure of shield terminals comprising:

two shield terminals each having a ring-shaped portion which a braided wire of a shield electric wire is inserted into and connected to, a plate portion extended from the ring-shaped portion along the shield electric wire, and a projecting piece extended perpendicular to the plate portion from a tip of the plate portion and having a bolt-insertion hole at a center thereof, wherein one wall of the projecting piece is positioned on an extension of a center line of the ring-shaped portion, wherein one shield terminal of the two shield terminals is inverted 180 degree with respect to the other shield terminal, and wherein the one wall of the projecting piece of the one shield terminal is overlapped with and abutted on the one wall of the projecting piece of the other shield terminal.

According to the above structure, while the projecting pieces of the two shield terminals are overlapped with and abut on each other, the center lines of the ring-shaped portions, namely, portions into which the shield wires are inserted are matched with each other. Therefore, by using two shield terminals having the same shape and the same size, the two shield terminals are arranged left and right parallel to each other (symmetrically). The bolt-insertion holes of the overlapped projecting pieces are arranged coaxially and communicated with each other so that a single bolt (screw) can tighten and fix the shield terminals to a connecting and fixing side (for example, a conductive housing in claim 2). As the one wall, for example, a rear wall of the projecting piece of the one shield terminal is overlapped with and abuts on a rear wall of the projecting piece of the other shield terminal which is inverted 180 degree. Alternatively, a front wall of the projecting piece of the one shield terminal is overlapped with and abuts on a front wall of the projecting piece of the other shield terminal which is inverted 180 degree. In both cases, the one wall is positioned on an extension of a center line of the ring-shaped portion, namely, on an extension of a center line of the shield electric wire.

According to the invention claimed in claim 2, there is provided the connecting structure of shield terminals as claimed in claim 1, wherein a boss having a screw hole is provided on a conductive housing, and wherein the other wall of any one of the projecting pieces abuts on a front end of the boss, and a bolt is inserted into the bolt-insertion holes to tighten and fix both projecting pieces to the boss.

According to the above structure, for example, when a rear wall of the projecting piece is the one wall, the other wall is a front wall of the projecting piece. The one walls of the projecting pieces abut on each other, and the other walls of the projecting pieces are separated from each other back and forth. While the other wall of any one of the projecting pieces abuts on the front end of the boss of the conductive housing, both projecting pieces are tightened and fixed to the boss with a bolt. For example, the conductive housing is connected (joined) to a conductive metallic shield shell, the braided wire of the shield electric wire is connected to the shield shell via the shield terminal and the conductive housing, and for example, an electromagnetic noise received by the shield shell is grounded via the braided wire.

According to the invention claimed in claim 3, there is provided the connecting structure of shield terminals as claimed in claim 2, wherein the one wall of the projecting piece is positioned on an extension of a center line of a tubular wall of the conductive housing from which the shield electric wire is guided out.

According to the above structure, while the other wall of any one of the projecting pieces abuts on the front end of the boss of the conductive housing, the one wall of any one of projecting pieces is positioned on an extension of the center line of the tubular wall of the conductive housing, and positioned on an extension of the center line of the ring-shaped portion of the shield electric wire, namely, on an extension of a center line of the shield electric wire. A projecting length of the boss of the housing is specified in this way, so that the shield electric wire and the tubular wall are arranged coaxially. Thereby, for example, an outer peripheral wall of the ring-shaped cable seal attached to (inserted over) the shield electric wire closely abuts on an inner peripheral wall of the tubular wall without bias.

Advantageous Effects of Invention

According to the invention claimed in claim 1, when two of one type of shied terminals are used, and any one of them is inverted, the number of components and the component cost can be reduced. Further, when two shield terminals are connected to the connecting and fixing side with a single bolt, the operation man-hours can be reduced. Further, when the projecting pieces of the two shield terminals are respectively positioned inward, the connecting structure can be in a small space.

According to the invention claimed in claim 2, when two shield shells are tightened and connected to the conductive housing with a single bolt simultaneously, the operation man-hours can be reduced. Further, when the projecting pieces of the two shield terminals are respectively positioned inward in the conductive housing, the space in the conductive housing can be reduced, and the conductive housing can be downsized.

According to the invention claimed in claim 3, when the center of the ring-shaped portion of the shield terminal is aligned with the center of the tubular wall of the conductive housing, a ring-shaped cable seal closely abuts on an outer peripheral wall of the shield electric wire and an inner peripheral wall of the tubular wall without bias, thereby waterproof performance can be improved.

DESCRIPTION OF EMBODIMENTS

FIGS. 1 to 7 show an embodiment of a connecting structure of shield terminals according to the present invention.

Figure 1:
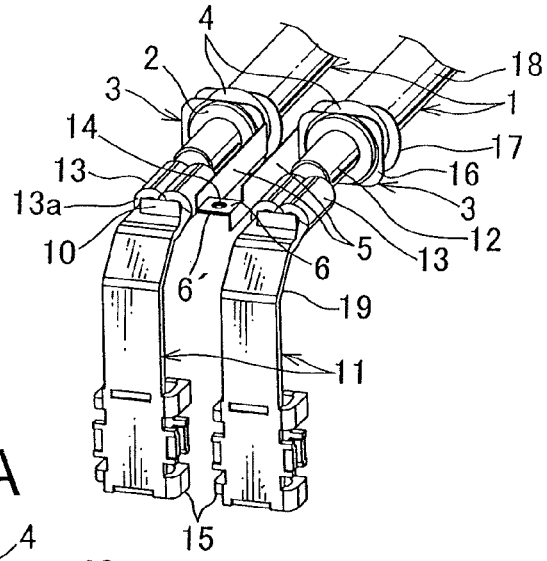
FIG. 1 is a perspective view showing an embodiment of a connecting structure of shield terminals according to the present invention.
Figure 5:
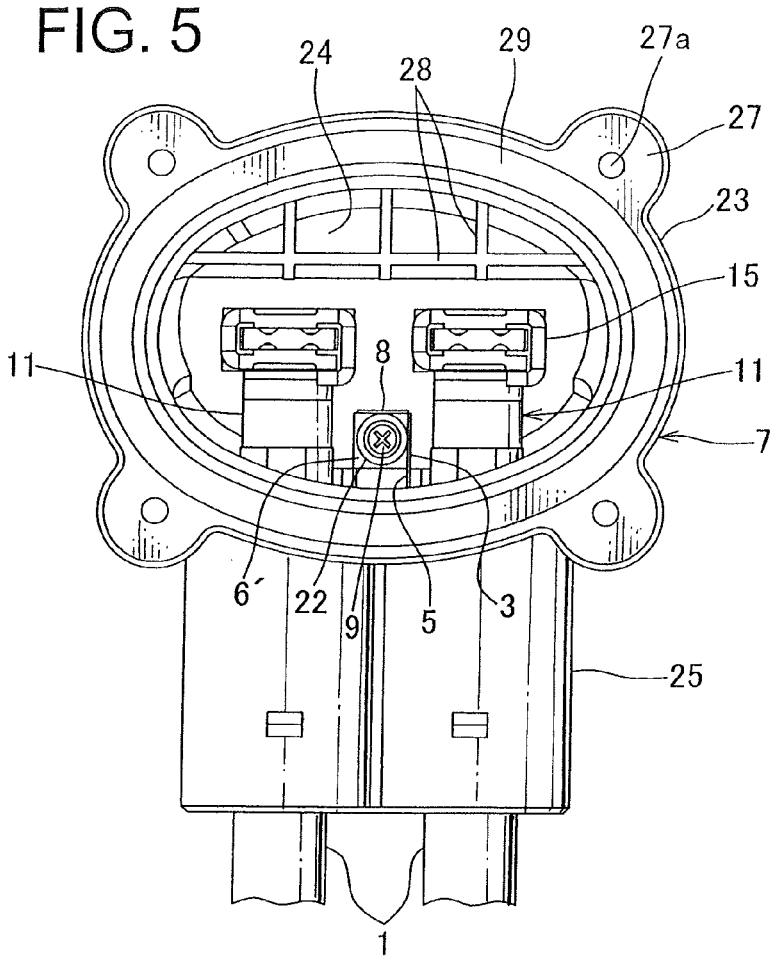
FIG. 5 is a front view showing a condition that the shield terminals are received in a conductive housing, and screwed to be connected to the conductive housing.
Figure 6:
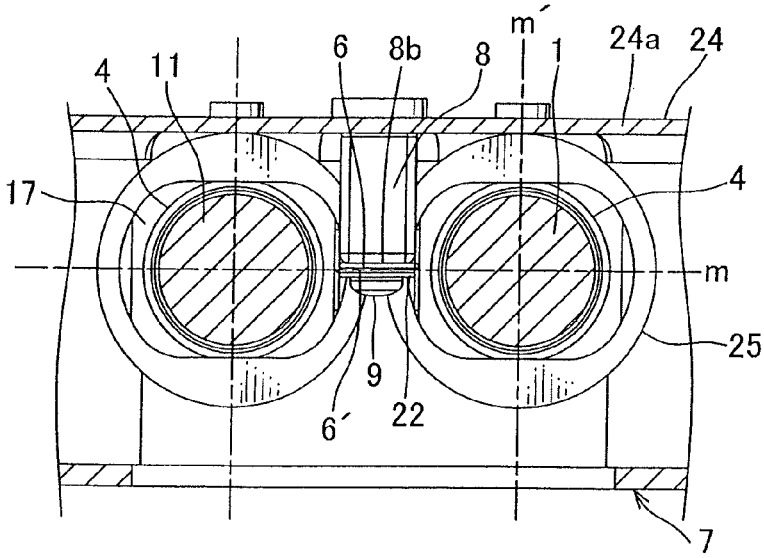
FIG. 6 is a transverse cross sectional view showing a condition that the shield terminals are screwed to be connected to the conductive housing.

As shown in FIG. 1, this structure is configured by inserting braided wires 2 (see FIG. 10) made of conductive metal of two shield electric wires 1 into ring-shaped portions 4 of shield terminals 3 having the same size and the same shape for common use and swaging the ring-shaped portions 4 to connect the ring-shaped portions 4 to the braided wires 2, and by overlapping projecting pieces 6, 6' formed perpendicular to tips of extending plate portions 5 of the shield terminals 3 with each other in a thickness direction, and then by screwing and connecting together the projecting pieces 6, 6' with a single bolt to a female screw portion 8 of a later-described conductive housing 7 made of aluminum shown in FIGS. 5 and 6. The projecting pieces are the same size and the same shape, however, for convenience shake, one is denoted by reference sign 6, and the other is denoted by reference sign 6'.

In FIG. 1, an L-shaped terminal 11 is pressure-bonded to a conductive-metal-made core wire 10 of each shield electric wire 1. Plate portions 5 of the shield terminals 3 are arranged parallel to the shield electric wires 1 in between insulating-resin-made inner sins 12 of the shield electric wires 1. (A thickness direction of the plate portion 5 is aligned with a direction of a virtual straight line joining the inner skins 12). A width direction of the projecting pieces 6, 6' interposed between wire crimping pieces 13 of the L-shaped terminals 11 is aligned to the direction of the virtual straight line. Hole portions 14 at the center of the projecting pieces 6, 6' are arranged back and forth and communicated with a projecting direction (a back and forth direction perpendicular to the virtual straight line) of a female-type electric contact portions 15 of the L-shaped terminals 11.

A rectangular flange portion 16 is formed at an upper end of the ring-shaped portion 4 of the shield terminal 3. The plate portion 5 is projected from the flange portion 16. The plate portion 5 is extended from the braided wire 2 (see FIG. 10) of the shield electric wire 1 to the core wire 10, namely, a little over an upper end 13*a* of the crimping piece 13 of the L-shaped terminal 11. The braided wire 2 is positioned in an inside of the ring-shaped portion 4. A ring-shaped shield sleeve 17 is positioned in an inside of the braided wire 2 (only a flange portion at a lower end of the shield sleeve is shown in FIG. 1). The braided wire 2 is folded and held between the ring-shaped portion 4 and the shield sleeve 17.

An insulating-resin-made outer skin 18 of the shield electric wire 1 is positioned at a lower side of the shield sleeve 17. The L-shaped terminal 11 is composed of the female-type electric contact portion 15 to which a mating male terminal (not shown) is inserted, and a substantially L-shaped plate portion 19 continued to the electric contact portion 15, and the crimping piece 13 formed on a lower side of the plate portion 19.

Figure 2A:
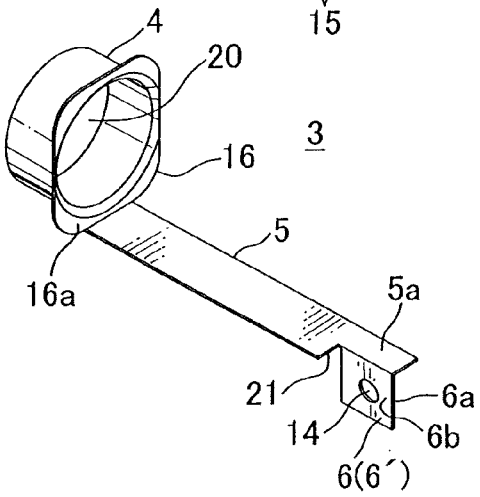
FIG. 2A is a perspective view showing an embodiment of a shield terminal according to the present invention.
Figure 2B:
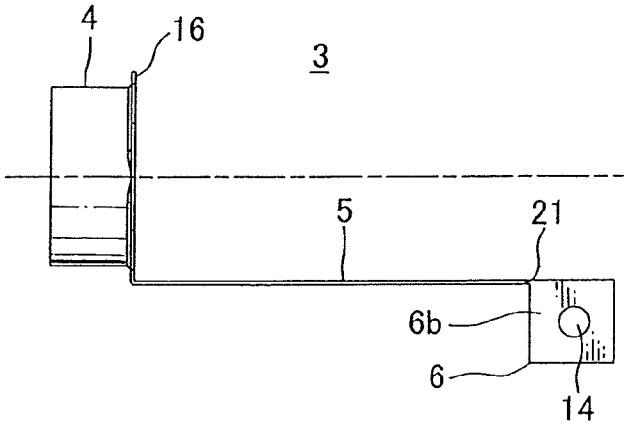
FIG. 2B is a side view showing the embodiment of the shield terminal.

As shown in FIGS. 2A and 2B, the ring-shaped portion 4 of the shield terminal 3 is formed in a short cylinder shape, and has a wire insertion hole 20 at an inside of the ring-shaped portion 4, and a rectangular flange portion 16 perpendicular to an upper end of the ring-shaped portion 4. A slim straight plate portion 5 is projected (extended) from one side 16*a* of the flange portion 16 in an axial direction of the ring-shaped portion 4. A notch portion 21 notched to the center of a width (half of a width size) of the plate portion 5 is provided at a tip of the plate portion 5. A rectangular projecting piece 6 (6') is provided at a tip of the plate portion 5 perpendicular to the plate portion 5 in the notch portion 21. A bolt-insertion hole portion 14 is provided at the center of the projecting piece 6 (6').

Figure 2C:
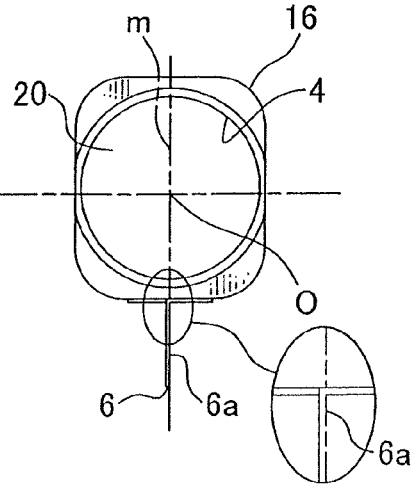
FIG. 2C is a partially enlarged (in a circle) plan view of the shield terminal.

When the shield terminal 3 of FIG. 2A is the right-side shield terminal 3 of FIG. 1, a rear wall 6*a* (one wall) of the projecting piece 6' of the left-side shield terminal 3 of FIG. 1 is overlapped with and abuts on the rear wall 6*a* of the projecting piece 6 of the shield terminal 3 of FIG. 2. As shown in FIG. 2C, the rear wall 6*a* of the projecting piece 6 is positioned on an extension of the center line (m) of the ring-shaped portion 4 as a shield wire insertion portion in an X direction (a radius direction of the ring-shaped portion 4 and a width direction of the plate portion 5). The center line (m) of the ring-shaped portion 4 is aligned with the center line (m) of the shield electric wire 1 in the X direction. (The center 'o' of the ring-shaped portion 4 is aligned with the center of the shield electric wire 1).

The rear wall 6*a* is in a side opposite to the notch portion 21, and perpendicular to a rear wall (outer side wall) of a tip portion 5*a* having a half width size of the plate portion 5. The rear wall 6*a* of the projecting piece 6 of the left-side shield terminal 3 of FIG. 1 is also positioned on an extension of the center line (in) of the ring-shaped portion 4 of FIG. 2C, namely, on an extension of the center line of the shield electric wire 1. The shield terminal 3 of FIG. 2 is commonly used as shield terminals 3 of the pair of shield electric wires 1.

Figure 3:
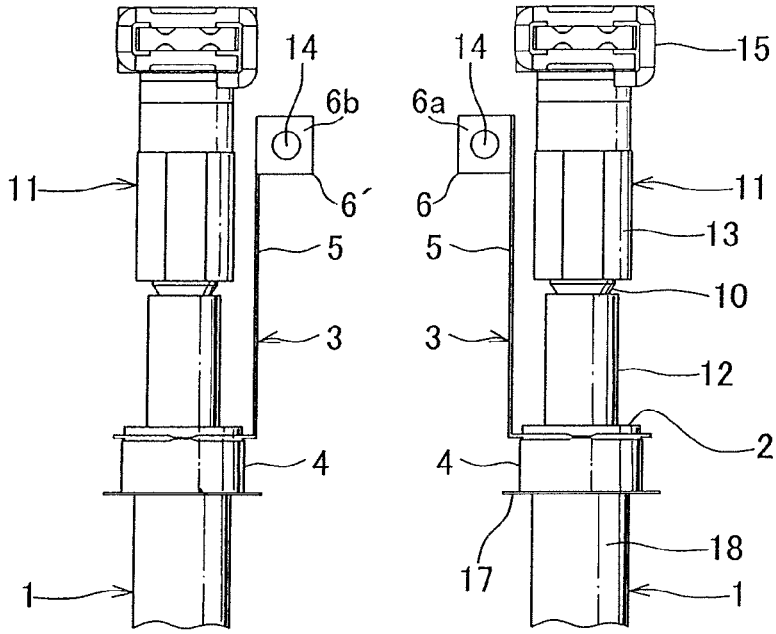
FIG. 3 is a front view showing a condition that the shield terminal and the inverted shield terminal are respectively connected to two shield electric wires.

As shown in FIG. 3, the front wall (the other wall) 6*b* of the projecting piece 6' of the left-side shield terminal 3 is positioned at a front side of FIG. 3. The rear wall 6*a* of the projecting piece 6 of the right-side shield terminal 3 is positioned at a front side of FIG. 3. In FIG. 3, reference sign 5 denotes the plate portion, 4 denotes the ring-shaped portion, 17 denotes a flange portion of the shield sleeve, 11 denotes the L-shaped terminal, 15 denotes the electric contact portion, 13 denotes the crimping piece, 10 denotes the core wire, 12 denotes the inner skin, and 18 denotes the outer skin.

Figure 4:
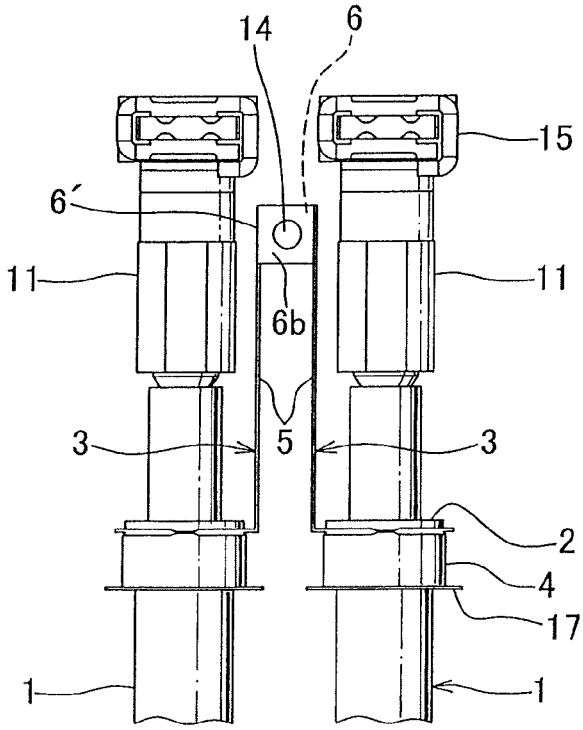
FIG. 4 is a front view showing a condition that the shield terminals abut on each other.

As shown in FIG. 4, while the left and right shield terminals 3 are positioned close to each other at the same height in the radial direction, the projecting pieces 6, 6' of the shield terminals 3 are overlapped with each other back and forth. The projecting piece 6' of the left-side shield terminal 3 of FIG. 3 is positioned at a front side (a projecting direction of the electric contact portion 15 of the L-shaped terminal 11) of the projecting piece 6 of the right-side shield terminal 3. In FIG. 4, a front wall 6*b* of the left-side projecting piece 6' is shown at a front side of FIG. 4.

As shown in FIGS. 5 and 6, the projecting pieces 6, 6' of the shield terminals 3 connected and fixed to the braided wires 2 of the shield electric wires 1 having the left and right pair of L-shaped terminals 11 of FIG. 4 are tightened and fixed to an inside of a metallic conductive housing 7 with a single bolt (small screw) 9 and a washer 22 while the projecting pieces 6, 6' are overlapped with each other.

Figure 7:
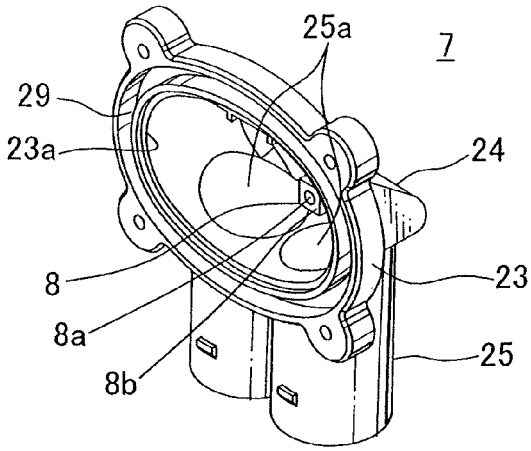
FIG. 7 is a perspective view showing an embodiment of the conductive housing.

As also shown in FIG. 7, the conductive housing 7 includes: an oblong ring-shaped wall 23; a bulged wall 24 integrally continued to a rear side of the ring-shaped wall 23; and left and right pair of tubular walls integrally continued to a lower side of the bulged wall. A rectangular-sectional-shaped boss (projecting wall) 8 is projected horizontally on a rear wall 24*a* of the bulged wall 24 and in an inside of a front opening 23*a* of the ring-shaped wall 23. A female screw hole 8*a* is provided on an inside center of the boss 8. While the projecting pieces 6, 6' of both shield terminals 3 are overlapped with each other, the bolt 9 is screwed into the female screw hole 8*a* though the hole portions 14 of both projecting pieces 6, 6' from the front opening 23*a*. The braided wire 2 of the shield electric wire 1 is connected to the conductive housing 7 via the projecting piece 6, 6' of the shield terminal 3 for the shielding purpose. The conductive housing 7 is connected to a later-described shield shell 26 (FIG. 11) for the shielding purpose.

In FIG. 5, reference sign 27 denotes a small flange portion projected outward from the ring-shaped wall 23 (flange wall) having a hole 27*a*. Reference sign 28 denotes ribs extended horizontally and vertically in the bulged wall 24, and 29 denotes a peripheral groove for a packing. In FIG. 6, reference sign 4 denotes a ring-shaped portion of the shield terminal 3, 17 denotes a flange portion of the shield sleeve, 5 denotes a plate portion, 6, 6' denote projecting pieces overlapped with each other back and forth, (m), (m') denote the center lines in X and Y directions of the ring-shaped portion 4.

In FIG. 6, the center line (m) in left and right direction (X direction) of the left and right ring-shaped portions 4 of the shield terminals 3 is positioned in the same plane as the front wall 6*a* (rear wall in FIG. 3) of the projecting piece 6, and positioned in the same plane as the rear wall 6*b* (front wall in FIG. 3) of the projecting piece 6' in a manner that the projecting piece 6 of the one (right-side) shield terminal 3 is overlapped with a front end wall 8*b* of the boss 8. The front end wall 8*b* of the boss 8 is positioned at a rear side (rear wall 24*a* side) in a thickness size of the one projecting piece 6 than the center line (m) in the X direction of the ring-shaped portion 4 of the shield terminal 3. The center line (m) of the ring-shaped portion 4 is aligned with the center line (m) of the tubular wall 25 of the conductive housing 7 into which the shield electric wire 1 is inserted. (The center of the ring-shaped portion 4 is aligned with the center of the tubular wall 25).

As shown in FIG. 7, upper openings 25*a* of the left and right pair of tubular walls 25 are positioned at a lower side of the bulged wall 24 of the conductive housing 7. Lower openings of the tubular walls 25 are communicated with the front opening 23*a* of the ring-shaped wall 23 via the upper openings 25*a* and a space in the bulged wall 24. The boss 8 having the female screw hole 8*a* is positioned at the upper center in between the left and right upper openings 25*a*.

In FIG. 5, for convenience shake, the L-shaped terminals 11 are exposed. However, in fact, as shown in FIG. 8, each L-shaped terminal 11 is received in an L-shaped inner housing 31 made of insulating resin.

Figure 9:
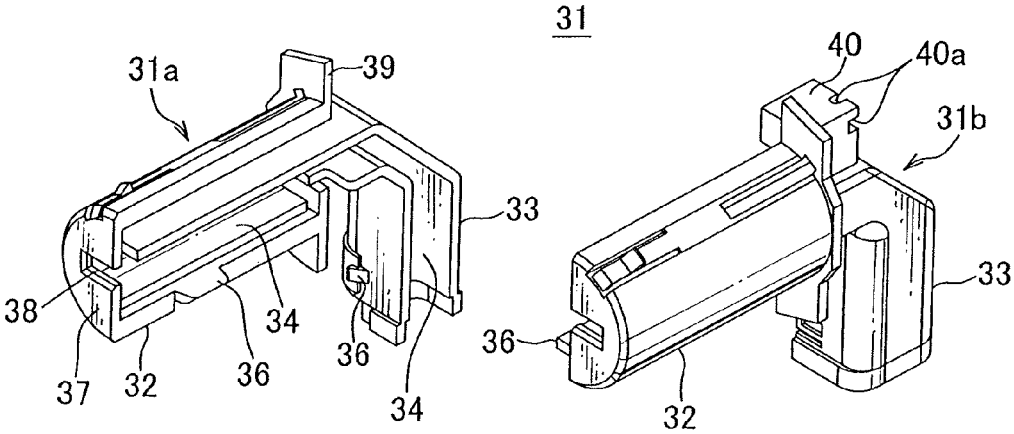
FIG. 9 is an exploded perspective view showing an embodiment of the inner housing.

As shown in FIG. 9, the inner housing 31 is dividable into left and right housings, and composed of a horizontal circular tube (horizontal portion) 32 and a vertical rectangular tube (vertical portion) 33. The left and right tubes 32 are joined together, and the left vertical tube 33 is engaged with the right vertical tube 33 to have a groove-shaped terminal receiving space 34. The left and right divided inner housings 31*a*, 31*b* are locked together with locking members 36 such as a locking nail and a locking frame piece. An insertion hole 38 for a mating male terminal (not shown) is provided on a front wall 37 of the inner housing 31.

The electric contact portion 15 of the L-shaped terminal 11 (FIG. 1) is received in the horizontal tube 32, and the crimping piece 13 of the L-shaped terminal 11 is received in the vertical tube 33. The inner housing 31 includes: vertical upper and lower flange portions 39 for holding the conductive housing 7; and a block portion 40 having a groove 40*a* for positioning. The groove 40*a* is engaged with the rib 28 (FIG. 5) of the conductive housing 7.

Figure 8:
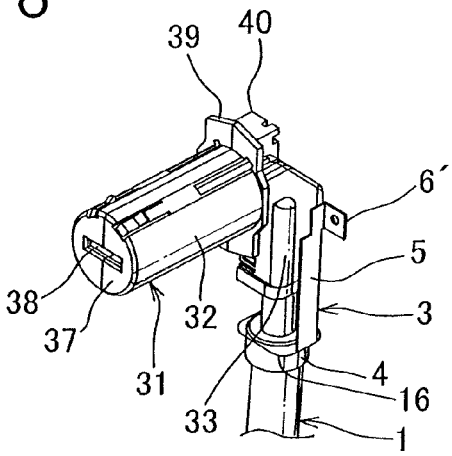
FIG. 8 is a perspective view showing a condition that an L-shaped terminal connected to the shield electric wire is covered by an inner housing.

As shown in FIG. 8, the plate portion 5 of the shield terminal 3 (explained with the left-side shield terminal) is positioned parallel to an outer wall of the vertical tube (vertical portion) 33 of the inner housing 31, and the tip projecting piece 6' of the plate portion 5 is positioned perpendicular to the outer wall of the vertical tube 33. In FIG. 8, reference sign 32 denotes a horizontal tube, 4 denotes a ring-shaped portion, 16 denotes a flange portion, and 40 denotes a block portion. The inner housing 31 may be dividable into upper and lower housings, not dividable into left and right housings.

Figure 10:
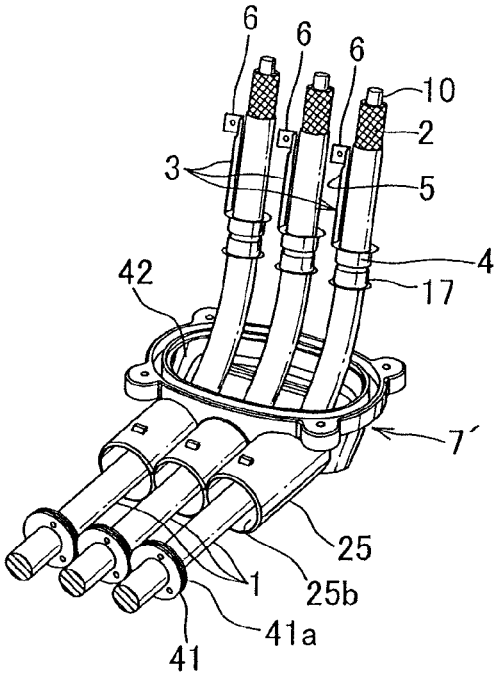
FIG. 10 is a perspective view showing a condition that three shield electric wires are used before the shield terminal is connected.

Further, as shown in FIG. 10, the number of shield electric wires 1 arranged parallel in the conductive housing 7' may be three, not two. The conductive housing 7' has three tubular walls 25. Similar to the embodiment shown in FIG. 5, as shown in FIG. 10, while the shield electric wire 1 is inserted into the conductive housing 7 (7'), the shield sleeve 17 and the shield terminal 3 are attached to the shield electric wire 1. Next, an end of the shield electric wire 1 is peeled so that the core wire 10 and the braided wire 2 are exposed, and then the L-shaped terminal 11 (FIG. 1) and the shield terminal 3 are connected and the inner housing 31 (FIG. 8) is attached.

From a condition that the inner housing 31 is attached as shown in FIG. 8, the shield electric wire 1 is pulled downward so that an inner housing assembly (composed of the L-shaped terminal 11 and the inner housing 31) and the shield terminal 3 are received in the conductive housing 7 (7'). Next, as shown in FIG. 5, the shield terminals 3 are fixed to the conductive housing 7 (7') with the bolt 9. In FIG. 10, reference sign 41 denotes a ring-shaped wire seal made of synthetic rubber which is previously inserted over the shield electric wire 1. An inner peripheral lip of the wire seal 41 is closely attached to the outer skin of the shield electric wire 1, and an outer peripheral lip 41*a* is closely attached to an inner peripheral wall 25*b* of the tubular wall 25 of the conductive housing 7 (7').

In the embodiment shown in FIG. 10, the projecting pieces 6 of the three shield terminals 3 are arranged in the same direction (left direction). When the left end shield terminal 3 is inverted 180 degree and the projecting piece 6 is turned right, and then overlapped with the projecting piece 6 of the center shield terminal 3, similar to the embodiment in FIG. 5, the two projecting pieces 6 are tightened with the single bolt 9, and a left side space 42 of the conductive housing 7' of FIG. 10 can be reduced. In the embodiment shown in FIG. 10, the two bosses 8 (FIG. 10) for fixing with the bolts 9 are arranged parallel to each other in the conductive housing 7'. From a condition shown in FIG. 10, the shield sleeve 17 and the shield terminal 3 are moved upward along the shield electric wire 1, and connected to the folded braided wire 2 (not folded in FIG. 10) by swaging.

Figure 11:
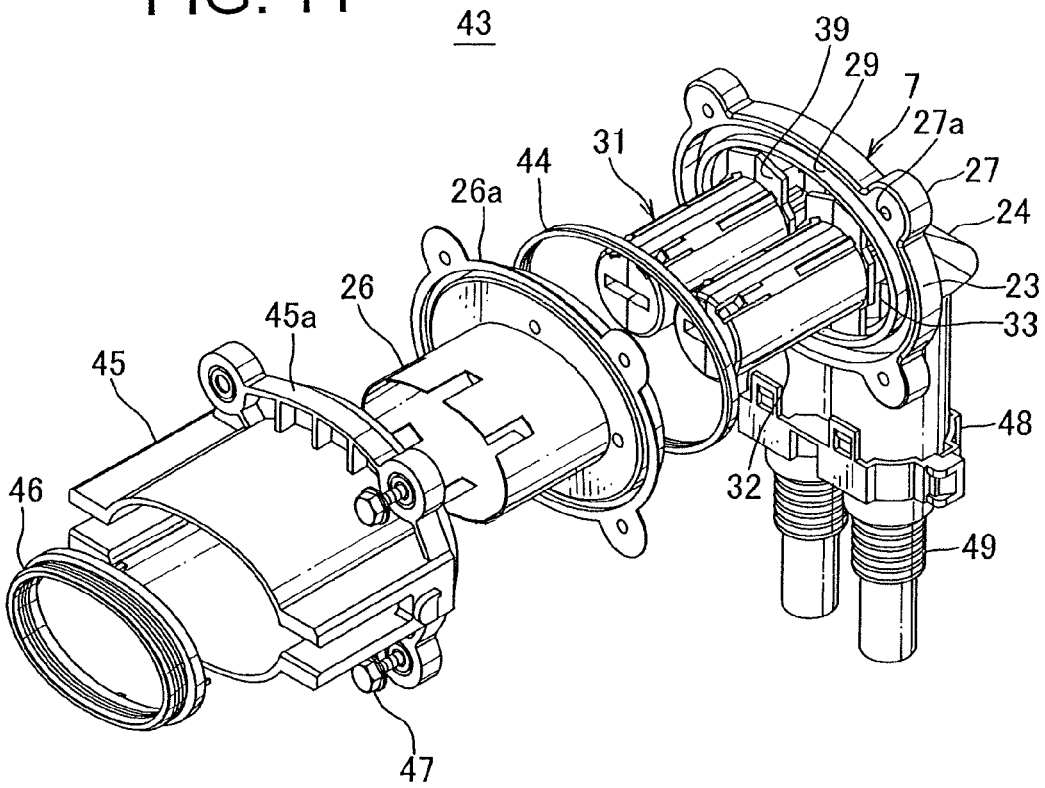
FIG. 11 is an exploded perspective view showing an embodiment of a connector to which the connecting structure of the shield terminal is applied.

FIG. 11 shows an embodiment of a watertight shield connector 43 using the connecting structure of shield terminals described above. The vertical portion 33 and the flange portion 39 of the inner housing 31 are received in the conductive housing 7. The horizontal portion 32 of the inner housing 31 is projected forward from the ring-shaped wall 23 of the conductive housing 7. In this condition, a shield packing 44 is attached to the peripheral groove 29 of the ring-shaped wall 23. The shield shell 26 made of conductive metal and an outer (front) housing 45 made of insulating resin are assembled onto the shield packing 44. A housing packing 46 is attached to between the shield shell 26 and the outer housing 45.

Holes of flange portions 45*a*, 26*a* of the outer housing 45 and the shield shell 26 are fixed to the screw hole 27*a* of the small flange portion 27 of the conductive housing 7 with a bolt 47 so that the flange portion 38 of the inner housing 31 is held between the flange portion 26*a* of the shield shell 26 and the conductive housing 7. The wire seal 41 (FIG. 10) is held in the conductive housing 7 by a holder 48 dividable into front and rear housings without falling out. The holder 48 also holds a corrugate tube 49.

Incidentally, in the embodiment described above, the braided wire 2 of the shield electric wire 1 is held between the ring-shaped portion 4 of the shield terminal 3 and the shield sleeve 17. However, it is also possible that the ring-shaped portion 4 of the shield terminal 3 may be directly connected to the braided wire 2 by swaging without using the shield sleeve 17.

Further, in the embodiment described above, the notch portion 21 (FIG. 2) is provided on the tip of the plate portion 5 of the shield terminal 3 to form the projecting piece 6 at the notch portion side. However, it is also possible that a width of the plate portion 5 becomes half to remove the notch portion 21.

Further, in the embodiment described above, the rear wall 6*a* of the projecting piece 6' of the other (left-side) shield terminal 3 is overlapped with the rear wall 6*a* of the projecting piece 6 of the one (right-side) shield terminal 3. However, when the front wall 6*b* of the projecting piece 6 of the shield terminal 3 shown in FIG. 2A is positioned on an extension of the center line (m) of the ring-shaped portion 4 of the shield terminal 3, the front wall 6*b* of the projecting piece 6' of the other (left-side) shield terminal 3 may be overlapped with the front wall 6*b* of the projecting piece 6 of the one (right-side) shield terminal 3. However, in a case that the rear walls 6*a* of the projecting pieces 6 abut on each other within a range of the width of the tip portion 5*a*, the space is further reduced.

Preferably, the shield terminal 3 is integrally formed by pressing and bending a sheet of conductive metal. However, it is possible that the plate portion 5 having the projecting piece 6 which is previously separated from the ring-shaped portion 4 is fixed to the ring-shaped portion 4 by welding or the like. The ring-shaped portion 4 may have a seam.

Further, the configuration in the embodiment described above is effective not only as the connecting structure of shield terminals but also as a connecting method of shield terminals, or as a connector using the connecting structure of shield terminals. If waterproofing of the connector 43 (FIG. 11) is not necessary, the seal and the packing may be cancelled.

INDUSTRIAL APPLICABILITY

The connecting structure of shield terminals according to the present invention can be applied to share the same type shield terminals for connecting a plurality of shield electric wires at low cost with a small number of screwing man-hours in a smaller space and to fix the shield terminals to a conductive housing to make a part of a shield connector.

REFERENCE SIGNS LIST

1 shield electric wire
2 braided wire
3 shield terminal
4 ring-shaped portion
6, 6' projecting piece
6*a* rear wall (one wall)
6*b* front wall (the other wall)
7 conductive housing
8 boss
8*a* screw hole
9 bolt
14 hole portion
25 tubular wall
(m) center line

The invention claimed is:

1. A connecting structure of shield terminals comprising:

two shield terminals each having a ring-shaped portion which a braided wire of a shield electric wire is inserted into and connected to, a plate portion extended from the ring-shaped portion along the shield electric wire, and a projecting piece extended perpendicular to the plate portion from a tip of the plate portion and having a bolt-insertion hole at a center thereof, wherein one wall of the projecting piece is positioned on an extension of a center line of the ring-shaped portion, wherein one shield terminal of the two shield terminals is inverted 180 degree with respect to the other shield terminal, and wherein the one wall of the projecting piece of the one shield terminal is overlapped with and abutted on the one wall of the projecting piece of the other shield terminal.

2. The connecting structure of shield terminals as claimed in claim 1, wherein a boss having a screw hole is provided on a conductive housing, and wherein the other wall of any one of the projecting pieces abuts on a front end of the boss, and a bolt is inserted into the bolt-insertion holes to tighten and fix both projecting pieces to the boss.

3. The connecting structure of shield terminals as claimed in claim 2, wherein the one wall of the projecting piece is positioned on an extension of a center line of a tubular wall of the conductive housing from which the shield electric wire is guided out.

* * * * *